United States Patent [19]

Lee et al.

[11] Patent Number: 4,827,177

[45] Date of Patent: May 2, 1989

[54] FIELD EMISSION VACUUM DEVICES

[75] Inventors: Rosemary A. Lee, Northwood; Neil A. Cade, Rickmansworth, both of England

[73] Assignee: The General Electric Company, p.l.c., United Kingdom

[21] Appl. No.: 92,426

[22] Filed: Sep. 3, 1987

[30] Foreign Application Priority Data

Sep. 8, 1986 [GB] United Kingdom ..... 8621600

[51] Int. Cl.[4] ..... H01J 19/24; H01J 19/38; H01J 19/46

[52] U.S. Cl. ..... 313/306; 313/309; 313/336; 313/355

[58] Field of Search ..... 313/336, 306, 355, 309

[56] References Cited

U.S. PATENT DOCUMENTS

| | | | |
|---|---|---|---|
| 3,359,448 | 12/1967 | Bashara et al. | 313/326 |
| 3,678,325 | 7/1972 | Nishida et al. | 313/309 X |
| 3,748,522 | 7/1973 | Geppert | 313/250 X |
| 3,788,723 | 1/1974 | Lehrer | 313/635 X |
| 4,578,614 | 3/1986 | Gray et al. | 313/336 X |
| 4,712,039 | 12/1987 | Hong | 313/306 X |
| 4,728,851 | 3/1988 | Lambe | 313/336 X |

FOREIGN PATENT DOCUMENTS

| | | |
|---|---|---|
| 0888955 | 2/1962 | United Kingdom . |
| 0923143 | 4/1963 | United Kingdom . |
| 2054959 | 2/1981 | United Kingdom . |
| 2109156 | 5/1983 | United Kingdom . |

*Primary Examiner*—Palmer C. DeMeo

*Attorney, Agent, or Firm*—Kirschstein, Kirschstein, Ottinger & Israel

[57] ABSTRACT

A vacuum valve device comprises a substrate on which is formed an updoped silicon layer from which a silicon dioxide layer is grown. First, second and third electrode structures are formed on the silicon dioxide layer by depositing a metallic layer and etching away unwanted portions of the layer. The first electrode structure has a pointed end and/or a sharp edge and/or is formed of low work function material so that, when a suitable voltage is applied between the first and third electrode structures, electrons are emitted from the first electrode structure due to a field emission process. Electrons therefore flow from the first to the third electrode structure substantially parallel to the substrate. The second electrode structure acts as a control electrode.

12 Claims, 3 Drawing Sheets

FIELD EMISSION VACUUM DEVICES

BACKGROUND OF THE INVENTION

1. Field of the Invention

This invention relates to vacuum devices.

2. Description of Related Art

In recent years there has been a resurgence of interest in vacuum devices as radiation hard alternatives to semiconductor devices. Known vacuum devices are however normally discrete, relatively large devices.

SUMMARY OF THE INVENTION

It is an object of the present invention to provide a vacuum device which is of relatively small dimensions and is capable of integration.

According to one aspect of the invention a vacuum device comprises a substrate; and at least first and second electrode structures of substantially co-planar construction formed on the substrate for electron flow from the first electrode structure to the second electrode structure substantially parallel to the substrate.

According to another aspect of the invention, a process for forming a vacuum device comprises forming on a common substrate at least first and second electrode structures of substantially co-planar construction for electron flow from the first electrode structure to the second electrode structure substantially parallel to the substrate.

The first electrode structure, when negatively biased relative to the second electrode structure, acts as a source of electrons (a cathode) preferably by virtue of its having a lower threshold voltage for electron emission or by virtue of its having a larger electric field strength at its surface than the second electrode structure. The electrons are emitted from the cathode by an electric field induced process, whereby the device operates at ambient temperatures without requiring internal or external heat sources, as would be required for thermionic emission.

The electrons are collected by the second electrode structure (an anode), which is biased positively with respect to the cathode, and since the anode is formed on the same substrate as the cathode, the electron motion is substantially parallel to the plane of the substrate.

The device may also include one or more additional structures, substantially co-planar with the first and second electrode structures, to act as control electrodes (i.e. grids) for modulating the cathode-anode current. Such control electrodes may operate by controlling the electric field at the cathode, thereby producing a large transconductance in the device, by virtue of the strong dependence of the emitted electron current on the field strength at the cathode.

BRIEF DESCRIPTION OF THE DRAWINGS

Embodiments of the invention will now be described, by way of example, with reference to the accompanying drawings, in which:-

DETAILED DESCRIPTION OF THE PREFERRED EMBODIMENTS

Figure 1:
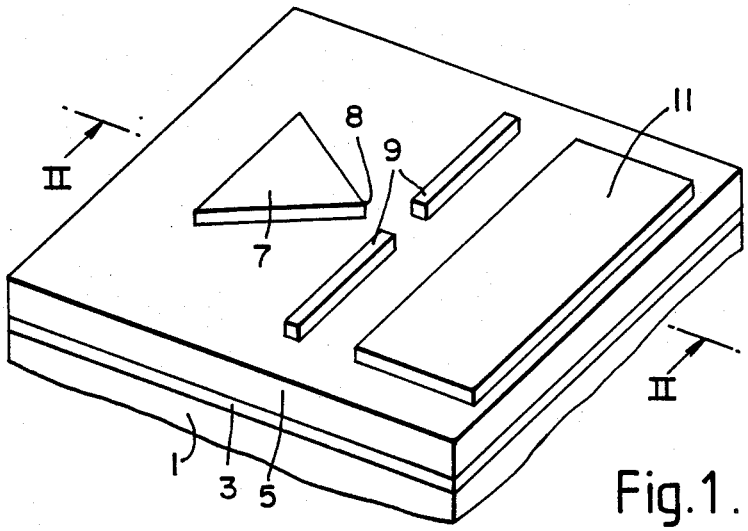
FIG. 1 is a schematic pictorial view of a first device in accordance with the invention, the scales of the components being distorted in order to clarify the figure.
Figure 2:
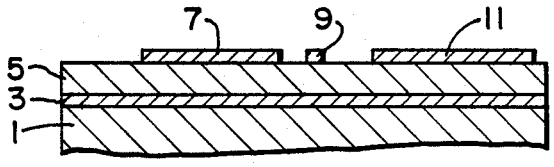
FIG. 2 is a cross section through the device of FIG. 1 along the line II—II.

Referring firstly to FIGS. 1 and 2, the first device to be described comprises a sapphire base 1 on which is grown an undoped silicon layer 3. The free surface of the layer 3 carries a thermally-grown silicon dioxide layer 5 which is between 1 and 2 $\mu$m thickness and is thereby able to withstand electric fields of $2\times10^8$ volts/meter. The growth of this oxide layer preferably results in the complete oxidation of the layer 3. On this layer 5 there are formed three metallic electrode structures 7, 9, 11 constituting respectively the cathode, grid and anode of the device, as further explained below. The electrode structures are formed on the underlying silicon dioxide layer 5 by evaporation or sputtering of a metallic layer of a few hundred angstroms to a few microns in thickness covering the layer 5. A lithographic technique is then used to etch through portions of the metallic layer selectively to produce the electrode shapes as shown in the figure. The cathode, grid and anode electrode structures 7, 9 and 11 respectively, thus formed are therefore coplanar. The whole device is then encapsulated, either as a single unit or with a number of similar devices formed on the same sapphire base, within a suitable evacuated enclosure (not shown).

In use of the device, a voltage source (not shown) is connected across the cathode and anode electrode structures 7 and 11. Due to the high field gradients in the vicinity of the apex of the cathode electrode structure 7, that structure will have a lower electron emission threshold voltage than the anode electrode structure 11 and, for negative biases exceeding this threshold value, will emit electrons by an electron field emission process.

The high electric field at the emission tip 8 of the cathode structure 7 is due to the thinness of the metal layer, the lithographic shaping in the plane of the layer, and its close proximity to the positively-biased grid 9 and/or anode 11 electrodes.

Hence, the device may be made to operate as a rectifier, with a preferred direction of electron flow when the cathode is negative with respect to the anode structure. Suitable electrical biases may be applied to the grid electrode structure 9 in order to further modulate this electron flow. Non-linear characteristics suitable for digital switching applications may readily be achieved, and the operation of the device is particularly fast as its speed will not be limited by the velocity of sound, which normally limits the speed of operation of solid state devices.

It will be appreciated that, whilst in the device described above the cathode electrode structure 7 and the anode electrode structure 11 are formed from the same metallic layer, the difference in electron emissivity between the cathode and anode electrode structures may be enhanced further by choosing materials of different thicknesses, layers of different shapes in the electrode plane or materials of different work functions for these two structures. Any inhomogeneity in the material composition of the cathode structure will further enhance the local field strength, thereby also increasing the electron emissivity of the cathode electrode structure. In particular, the electron emissivity of the cathode electrode structure may also be increased by the implantation of suitable dopant materials, resulting in increased electron emission from the implanted sites. One particularly suitable dopant material is carbon. It will be appreciated that in some devices in accordance with the invention a layer of material such as carbon may advantageously be carried on the surface of the cathode structure rather than implanted therein.

Figure 3:
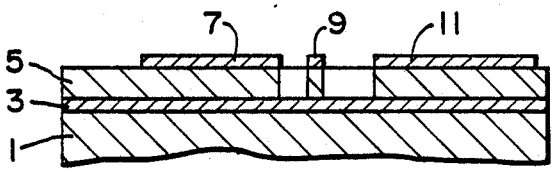
FIG. 3 is a cross section through a first modification of the device of FIG. 1.
Figure 4:
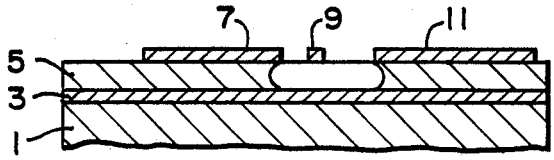
FIG. 4 is a cross section through a second modification of the device of FIG. 1.

Turning now to FIG. 3, in order to reduce the danger of electronic short circuits through the silicon dioxide layer 5, it may be advantageous to etch through at least part of this layer between the cathode 7 and grid 9 electrode structures and between the grid 9 and anode 11 electrode structures to produce the supported electrode structures 7, 9, 11 as shown in this figure. Subsequent isotropic etching may be used to produce undercut electrode structures as shown in FIG. 4.

With modern lithographic techniques it is found that the above etching can be performed to produce devices of 1 μm and less separation between the anode and cathode electrode structures, this resulting in switch-on voltages of 100 volts and less.

Figure 5:
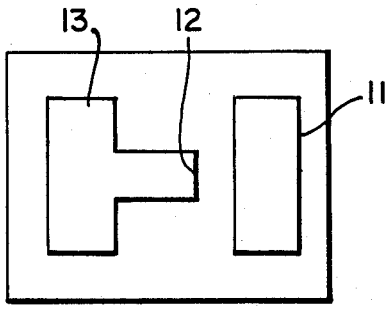
FIG. 5 is a schematic plan view of a second device in accordance with the invention.
Figure 6:
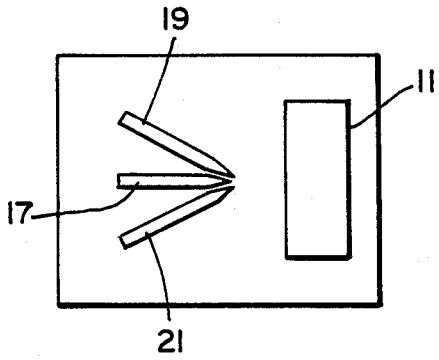
FIG. 6 is a schematic plan view of a third device in accordance with the invention.
Figure 7:
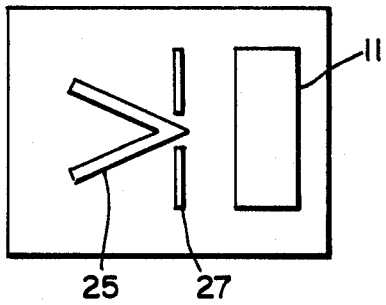
FIG. 7 is a schematic plan view of a fourth device in accordance with the invention.

Turning now to FIGS. 5, 6 and 7, it is clear that many alternative configurations are possible for devices in accordance with the invention. In particular, a grid structure need not be incorporated. FIG. 5 shows one such device in which a wide emission edge 12 of a cathode 13 allows a larger current flow than the cathode tip 8 of FIG. 1. For operation as a diode device with an applied voltage of about 100 v, the gap between the cathode 13 and the anode 11 should be approximately 1 μm, but will be dependent upon both the work function of the cathode 13 and the thickness of the metal of the cathode. Generally such a cathode electrode structure would be formed of a lower work function material than that of the anode structure.

FIG. 6 shows a device configuration in which a cathode electrode structure 17 is of needle-like form, the grid electrode structure comprising two similar needle-like conductive patterns 19 and 21 and the anode electrode structure 11 being of rectangular form as before. Such a device configuration results in a particular sensitivity of the device characteristics to electric fields applied across the grid electrode structure.

The same is true of a device configuration shown in FIG. 7, in which a cathode electrode structure 25 is of "V" formation. In this configuration a grid electrode structure 27 is disposed round the tip of the "V" structure, so that particularly strong field gradients are present round the tip of the cathode 25. Such a disposition of the grid 27 should allow operation of the device with the grid biased negatively with respect to the cathode. In such a case, the anode 11 would have to be approximately 1 μm from the tip of the cathode 25 in order to allow operation with a 100 volt potential difference between the anode 11 and the cathode 25.

It will be appreciated that where the grid electrode structure is to be negatively biased, this electrode structure will generally be formed from a material of higher work function than that of the cathode structure in order to avoid electron emission from the grid electrode structure. Such devices will, of course, require a two stage metallisation process in order to deposit the required electrode structures. In addition, such a two stage metallisation will also be required to provide a thicker anode structure, which will again give assymmetric current/voltage characteristics as a result of lower geometric field enhancement at the anode.

Figure 8:
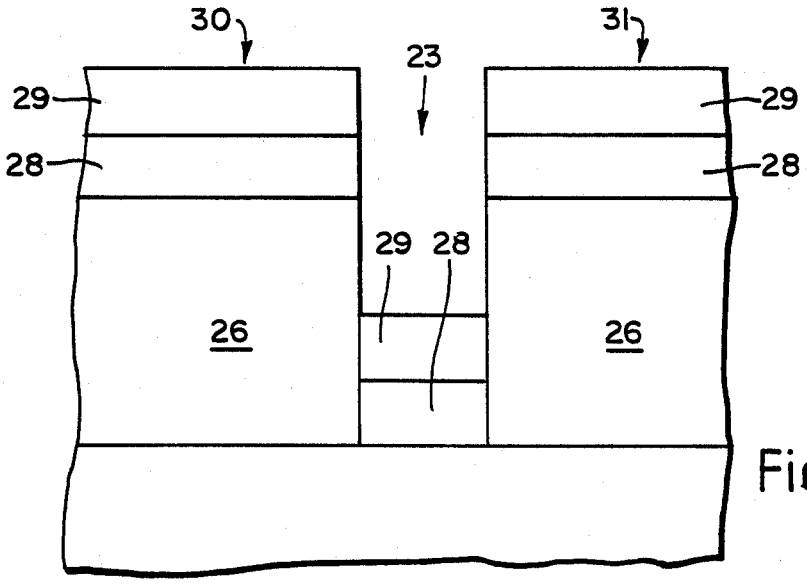
FIG. 8 is a schematic cross section through a fifth device in accordance with the invention.

For particularly small devices requiring two-stage metallisation, a self-aligning metallisation process is desirable. FIG. 8 shows a device in which an etched channel 23 is formed in a silicon dioxide layer 26, an initial metallisation of a low work function material 28 being followed by a metallisation of a high work function material 29 using the same masking structures. The upper metallised area within the channel 23 may be used as a grid electrode structure. Since the initial low work function layer 27 in the channel 23 is completely covered by the high work function layer 29, this grid electrode can be operated either positively or negatively with respect to the upper electrodes 30 and 31. It should be noted that the configuration of FIG. 8 allows an operable device to be achieved with a close spacing of the cathode, anode and grid structures, irrespective of the number of metallisations.

It is found that for devices of the general forms shown in FIGS. 1 to 8, reasonable operating voltages are possible for anode-cathode electrode structure separations of between 0.5 and 20 μm, the grid electrode structure being biased between the cathode and anode voltages at separations of up to 5 μm from the cathode electrode structure.

Figure 9:
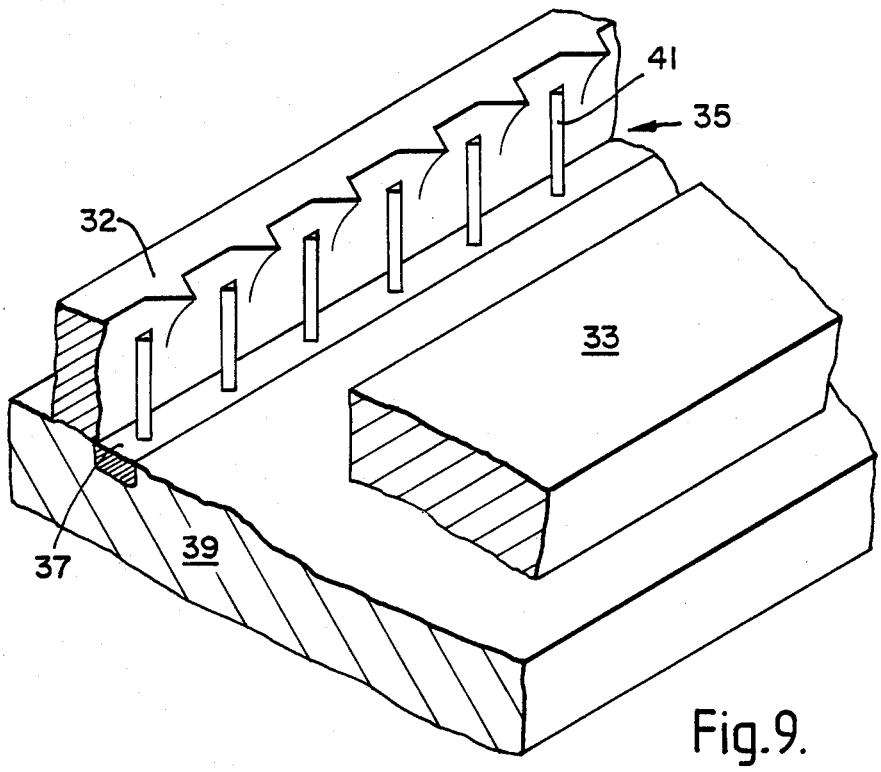
FIG. 9 is a schematic view of a sixth device in accordance with the invention.

More complex electrode structures are, of course, possible. FIG. 9 shows a device in which a cathode electrode structure 32 is in the form of multiple undercut tips, and an anode electrode structure 33 is in the form of a rectangular strip, as before. A grid electrode structure 35 comprises a series of metallic pins 41 anchored to a doped stripe 37 in the underlying silicon 39.

It will be appreciated that whilst in the devices described above the electrode structures are carried on a layer of silicon dioxide grown from a layer of silicon, which is in turn carried on a sapphire base, the electrode structures may be carried by any large band gap insulating substrate. The use of a sapphire base is particularly useful, however, as sapphire is a radiation hard material and is readily available with an epitaxial silicon layer, which can be oxidised to give an easily etchable substrate.

We claim:

1. A field emission vacuum device, comprising:

(a) an insulating substrate having a planar surface;

(b) electron emission electrode means, control electrode means and electron collection electrode means, all formed on said planar surface in a coplanar configuration and being located within an evacuated space;

(c) said emission electrode means having at an end at least one region constructed for enhanced field emission therefrom, whereby electrons emitted from said at least one region flow to said collection electrode means along a path which is substantially parallel to said planar surface;

(d) said control electrode means being so formed as to lie substantially outside said path.

2. The device as claimed in claim 1, wherein said emission electrode means has a lower work function than said collection electrode means, whereby electrons are preferentially emitted from said emission electrode means.

3. The device as claimed in claim 1, wherein said at least one region of said emission electrode means comprises a thin edge.

4. The device as claimed in claim 1, wherein said at least one region of said emission electrode means comprises a pointed region.

5. The device as claimed in claim 1, wherein said emission electrode means includes an implanted dopant for enhancement of electron emission for said at least one region.

6. The device as claimed in claim 1, wherein said emission electrode means has a surface coating for enhancement of electron emission from said at least one region.

7. A field emission vacuum device, comprising:

(a) an insulating substrate having a channel therein;

(b) a first conductive layer having a first portion deposited in said channel and second and third portions deposited on said substrate on opposite sides of said channel;

(c) said first, second and third portions being electrically isolated from each other and said second and third portions forming, respectively, electron emission electrode means and electron collection electrode means;

(d) a second conductive layer having first, second and third portions deposited on said first, second and third portions, respectively, of said first layer, said first portion of said second layer forming control electrode means;

(e) said second layer being of a higher work function material than said first layer; and (f) at least said control electrode means, said electron emission electrode means and said electron collection electrode means being contained in an evacuated space.

8. The device as claimed in claim 7; and further comprising an electrically insulating layer between at least two of said electrode means and said substrate, and wherein portions of said insulating layer are removed from between said at least two electrode means.

9. The device as claimed in claim 8, wherein said removed portions extend beneath adjacent edges of said at least two electrode means.

10. The device as claimed in claim 7, wherein portions of said substrate are removed from between said electrode means.

11. The device as claimed in claim 10, wherein said removed portions extend beneath adjacent edges of said electrode means.

12. The device as claimed in claim 7; said second layer being less electrically emissive than said first layer.

* * * * *